US006543556B1

(12) United States Patent
Anderson

(10) Patent No.: US 6,543,556 B1
(45) Date of Patent: Apr. 8, 2003

(54) ABNORMAL TORQUE ABSORBER FOR DRILLING

(75) Inventor: Edwin A. Anderson, Houston, TX (US)

(73) Assignee: Smith International, Inc.

( * ) Notice: Subject to any disclaimer, the term of this patent is extended or adjusted under 35 U.S.C. 154(b) by 0 days.

(21) Appl. No.: 09/380,895

(22) PCT Filed: Mar. 11, 1998

(86) PCT No.: PCT/US98/04751

§ 371 (c)(1),
(2), (4) Date: Sep. 11, 1999

(87) PCT Pub. No.: WO98/40600

PCT Pub. Date: Sep. 17, 1998

Related U.S. Application Data

(60) Provisional application No. 60/040,438, filed on Mar. 12, 1997.

(51) Int. Cl.[7] ..... E21B 31/00; E21B 17/02

(52) U.S. Cl. ..... 175/293; 166/178; 175/320; 175/322

(58) Field of Search ..... 175/293, 320, 175/321, 322; 464/19, 20; 166/178

(56) References Cited

U.S. PATENT DOCUMENTS

| | | | | | |
|---|---|---|---|---|---|
| 3,223,187 | A | * | 12/1965 | Cleary | 175/320 |
| 4,502,552 | A | * | 3/1985 | Martini | 175/56 |
| 5,224,898 | A | * | 7/1993 | Johnson et al. | 464/20 |
| 5,323,852 | A | * | 6/1994 | Cornette et al. | 166/51 |
| 5,372,548 | A | * | 12/1994 | Wohlfeld | 464/20 |

* cited by examiner

*Primary Examiner*—Hoang Dang

(57) ABSTRACT

A torque shock absorber apparatus (39) comprised of a mandrel (2) and cylinder (8) with torque absorbing mechanism (8–12, 27) to absorb excessive torque while permitting the transmission of rotational energy to the drill string is connected in the drill string or as the drive mechanism in a jar or accelerator (40) to prevent excessive torque loading of the drill string.

7 Claims, 5 Drawing Sheets

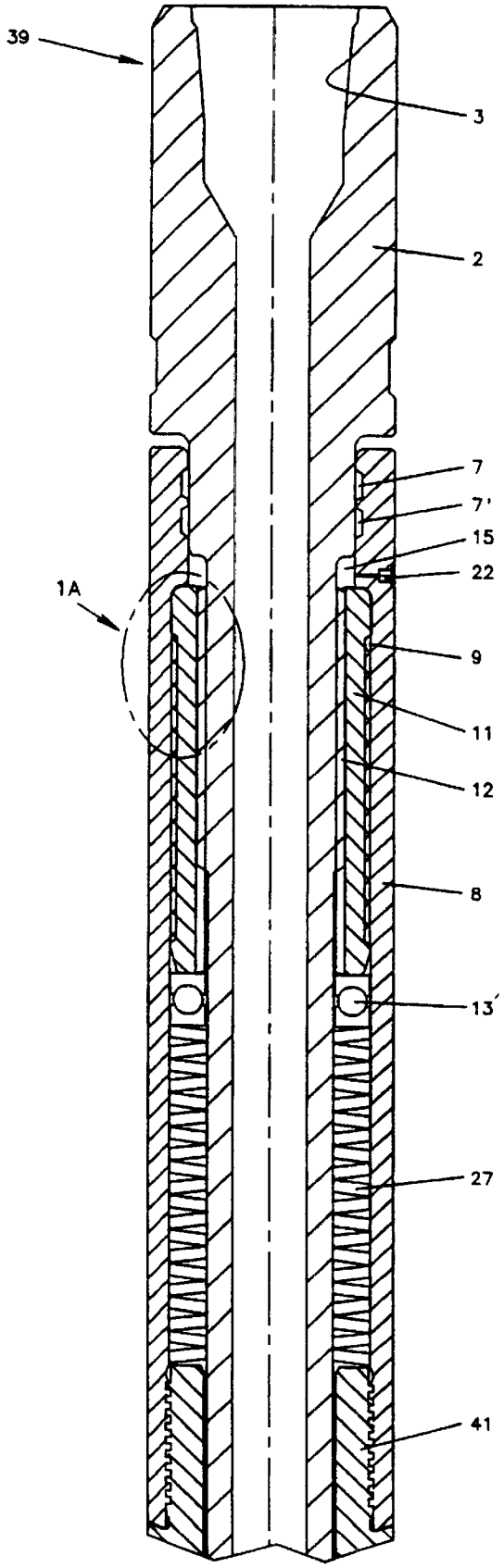
Fig. 1
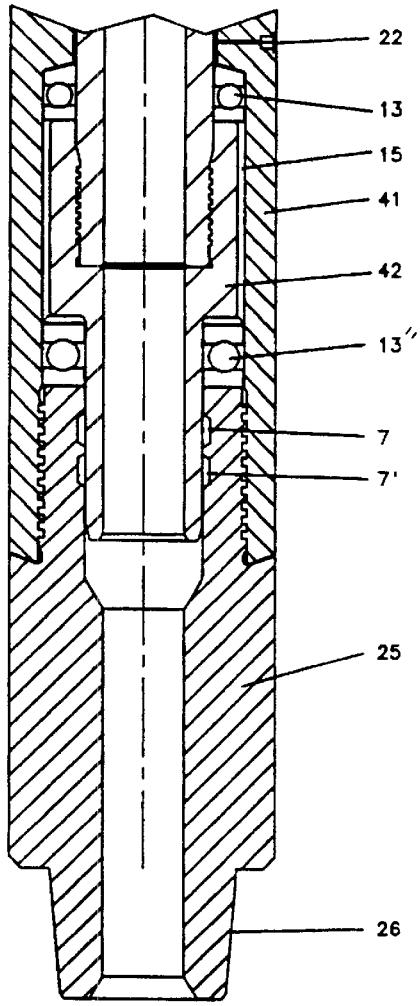

40
3
2
6'
4
6
54
7
7'
7''
8
22'
5
12'
11
4
4
12
9'
9
15
13
27
45
15'
45
48
16
2
15
50
52
26

ABNORMAL TORQUE ABSORBER FOR DRILLING

This application claims the benefit of Provisional Application No. 60/040,438, filed Mar. 12, 1997.

TECHNICAL FIELD

This invention relates to torque absorbing device for tubular members, specifically to devices for absorbing torsional shocks on tubular members used in drilling operations.

BACKGROUND ART

In the process of rotary drilling of wells, abnormal torque can cause stress on the drill string members which comprise the drill string assembly. Repetitive torque overload caused by a variety of phenomenon can cause failure of the drill string assembly. Excessive down hole torque has long been associated with bit-failure and drill string failure.

DISCLOSURE OF THE INVENTION

The present invention provides a torque-shock absorbing tool that will reduce or eliminate abnormal torque from being transmitted through the drill string, yet permit normal torque required for normal drilling operations to be imparted to the drill bit or other down-hole tool. The present invention provides a tool which acts intermediate the drill string and the bottom-hole-assembly (BHA) or bit to absorb abnormal rotation of the drill string (as from bit whirl). The present invention thereby permits normal operation to continue while allowing the use of jars, accelerators, and bumper subs with the tool in place. The invention may also be used as the drive section or portion of such tools without changing the use or operation of the tools.

The tool consists of a mandrel connected to the drill string and attached through an intermediate assembly to the lower sub assembly which both absorbs abnormal torque in the drill string.

If the source of the abnormal torque originates above the tool, the mandrel is helically compressed against a drive cylinder which allows continued rotational movement, while simultaneously absorbing (through both mechanical and hydraulic means) the abnormal torque.

If the source of the abnormal torque originates below the tool, the energy is transmitted to the torque absorber which drives the compression cylinder up, causing compression of the Belleville spring assembly, which in turn move the compression mandrel against the torque sleeve, a hydraulic and mechanical energy absorbing means in the drive cylinder. The dampening effect of the present invention from both directions and independent of the rotational energy which may be continued to be imparted the drill string realizes the long-desired but unobtained goal of a device which absorbs abnormal torque, but continues to provide rotational energy which is required to maintain movement of the drill bit on the well bottom.

An additional object of this tool is to provide a tool for use with polycrystalline diamond compact bits in which the torque-arresting means will address bit whirl, both clockwise and counterclockwise.

A still further object of this tool is to provide a tool in which the tool has means to snub the tool both up and down to permit the tool's use with bumper subs, jars and accelerators, as needed.

Another related object of this tool is to provide a tool which, in the event that it is necessary to jar the drill-string, the shock tool will home out in both the up and down mode so as not to lessen the jar effect.

Another object of this tool is to provide a tool which will absorb abnormal torque in the drill string to provide the elimination of excessive torque on drill string joints, which will lessen the need for excessive force in loosening joints upon recovery of the well string.

Other objects and advantages of the tool will become apparent from a consideration of the following description and the drawings.

BRIEF DESCRIPTION OF THE DRAWINGS

FIG. 1—A vertical section view illustrating a preferred embodiment in an uncompressed, but torqued, mode.

BEST MODE FOR CARRYING OUT THE INVENTION

Figure 1A:
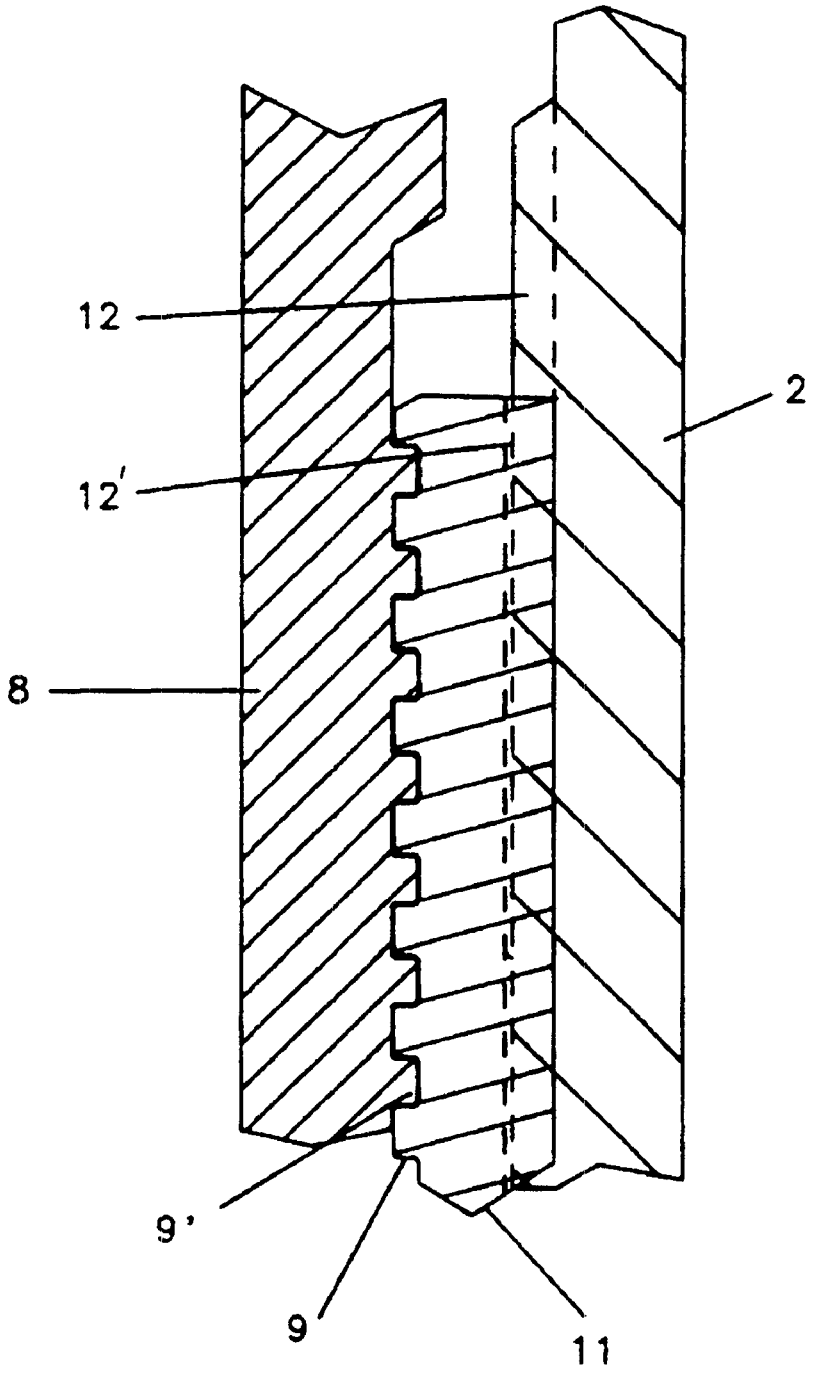
FIG. 1A—A vertical section view of the torque sleeve engagement of the drive cylinder threads and the mandrel splines.

FIG. 1 is a sectional view of the torque absorber which is designed to dampen or arrest abnormal torque in the drill string, while still allowing continued rotation to be applied to the drill string.

Torque absorber 39 is threadably connected in the drill string intermediate any portion that may be damaged by abnormal and repetitive torque loads. The torque absorber consists of a mandrel 2 engaged in bearing cylinder 41 and threadably engaged to bearing mandrel 42. The mandrel 2 is sealingly engaged by upper and lower sets of seals 7' and 7" adjacent the shoulder on mandrel 2 to prevent ingress of well fluids and egress of an incompressible fluid, such as gear oil, which is retained in the annular chamber 15 formed between the outer surfaces of mandrel 2 and bearing mandrel 42 and the inner surfaces of drive cylinder 8 and bearing cylinder 41. Annular chamber 15 is partially filled with an incompressible fluid such as oil through fill ports 22. Lower sub 25 is threadably engaged to bearing cylinder 41 and provides threaded pin connection 26 to engage the remainder of the drill string. Lower sub 25 also permits slideable engagement of bearing mandrel 42 by lower seal members 7 and retains thrust bearings 13' and 13" between the upper shoulder of lower sub 25 and the lower inner shoulder of bearing cylinder 41.

Torque is arrested in the apparatus by the movement of the torque sleeve within the drive cylinder which movement is resisted by the torque-resisting Belleville springs 27 and the hydraulic forces of the compression in inner chamber 15. As shown in FIG. 1, torque threads 9 urge the torque sleeve 11 toward compressive engagement with thrust bearing 13' and thereby into compressive engagement with the Belleville spring 27.

Torque sleeve 11 engages the outer surface of thrust bearing 13' which allows smooth rotational engagement in compression between the torque sleeve and the torque-resisting Belleville springs 27, which are carried on bearing cylinder 41 to arrest torque between torque absorber 39 and lower sub 26.

FIG. 1A is a cross-sectional view of the torque sleeve 11 engaged between the drive cylinder 8 and mandrel 2. As noted, mandrel 2 provides external splines 12 which engage internal splines 12' on the torque sleeve 11. As mandrel 2 supplies right-hand torque, the splines engage to move the threaded torque sleeve 11 into engagement with the threads of drive cylinder 8.

Again directing our attention to FIG. 1, when abnormal torque (such as from bit whirl) is experienced, lower sub 25 and bearing cylinder 41 move in a right-hand direction from the bit end of the assembly to the mandrel connection end. This right-hand torque is resisted by torque sleeve 11 which is moving in the right-hand threads of the drive cylinder 8, in relative motion toward the drill bit. The combination of the compressive movement of the Belleville spring, the torque thread movement and the hydraulic pressure from the fluid in chamber 15 offer increasing resistance to the abnormal torque and prevent such torque from being propagated up the drill string.

Figure 2:
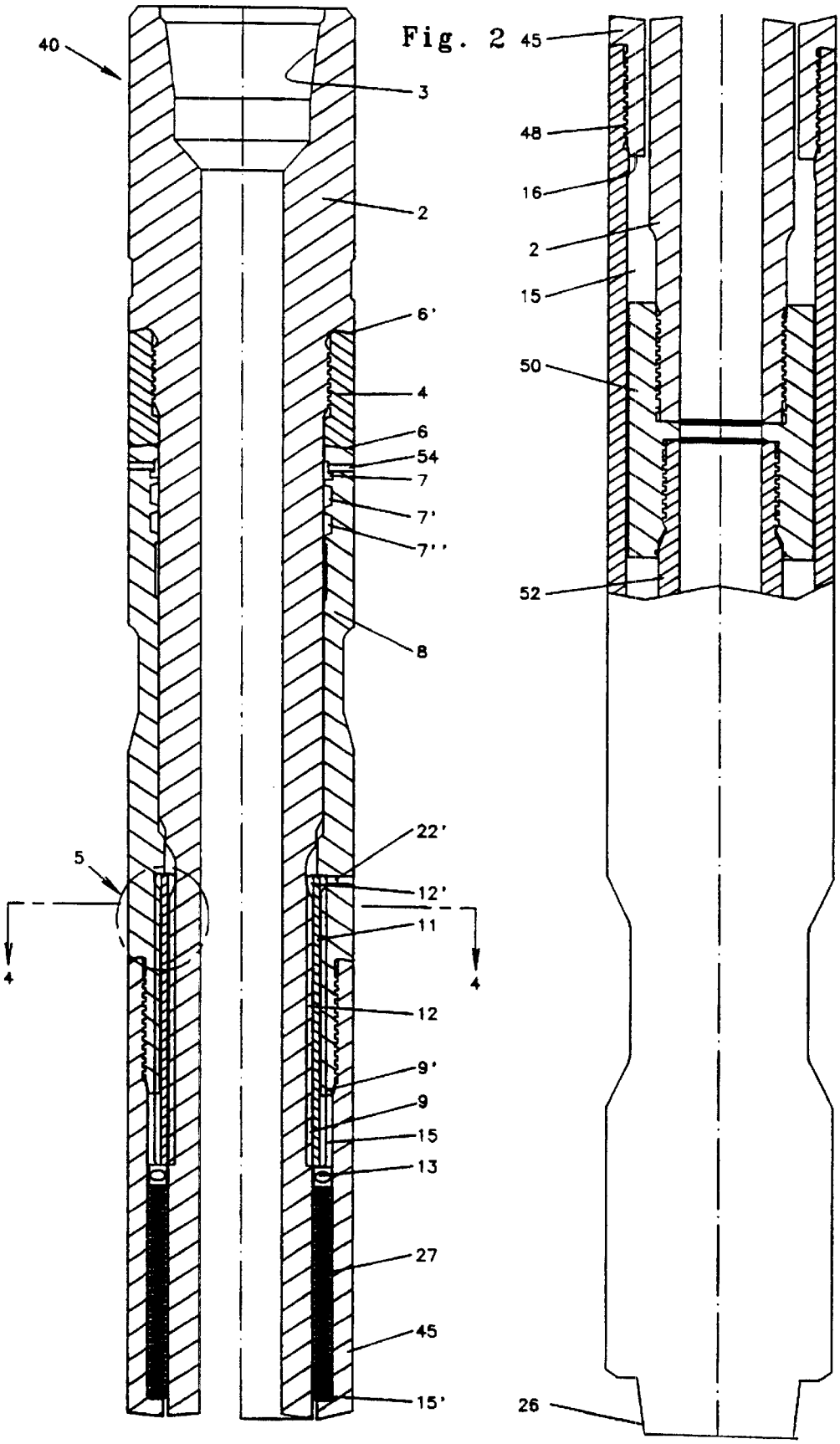
FIG. 2—A vertical section view illustrating another embodiment of the use of the torque absorber in a drilling jar apparatus.

FIG. 2 shows an alternative embodiment of the torque sleeve adapted for use in conjunction with a drilling jar and accelerator, such as those disclosed in U.S. Pat. No. 4,846,273, to Anderson. The tool of the invention when adapted for use with a drilling jar 40 is formed by engaging a mandrel 2, which is provided with a threaded box 3 in the normal manner, for connection into a drill string. The mandrel 2 is formed with shoulder 6' against which is seated wear ring 4 which provides the down-impact face 6 of the tool. Drive cylinder 8 telescopically and sealingly engages mandrel 2 by elastomeric seals 7, 7', and 7" permitting drive cylinder to move longitudinally on mandrel 6, while maintaining said seal. Mandrel 6 is further provided with external splines 12 to engage internal splines in a torque sleeve 11. Torque sleeve 11 is additionally formed with a plurality of external threads 9 which engage the internal threads 9' of the drive cylinder 8.

Drive cylinder 8 is threadedly engaged to spring cylinder 45 which provides Belleville support 15'. Spring cylinder 45 is threadedly engaged to fluid cylinder 48. Mandrel 2 extends telescopically through the spring cylinder and the fluid cylinder to threadedly engage knocker 50 which is connected to the upper detent mandrel 52 of a drilling jar mechanism as fully described in the U.S. Pat. No. 4,846,273. Knocker 50 slideably engages the inner diameter of the fluid cylinder 48 forming inner chamber 15 which is filled through fill port 22' with an incompressible medium such as oil or silicon. Such fluid is free to flow from the knocker 50 through the chamber formed between the outer wall of the mandrel 2 and the inner wall of the fluid cylinder 48, the spring cylinder 45, through the torque arresting Belleville spring 27, through the spline engagement and torque threads, and between the drive cylinder to the seals 7.

As unusual torque is experienced by drilling jar 40, torque sleeve 11 is urged to engage and rotate torque threads 9 and 9' in the direction opposite of their rotation caused by normal drilling operations, allowing further resistance from Belleville spring 27 which engages thrust bearing 13. Movement of the torque sleeve over the torque threads is further resisted by the compression of the fluid in the inner chamber 15 between the mandrel 2 and the drive cylinder 8.

Alternatively, tool 39 could be readily adapted for use as the drive mechanism of a jar tool as previously noted.

Figure 3:
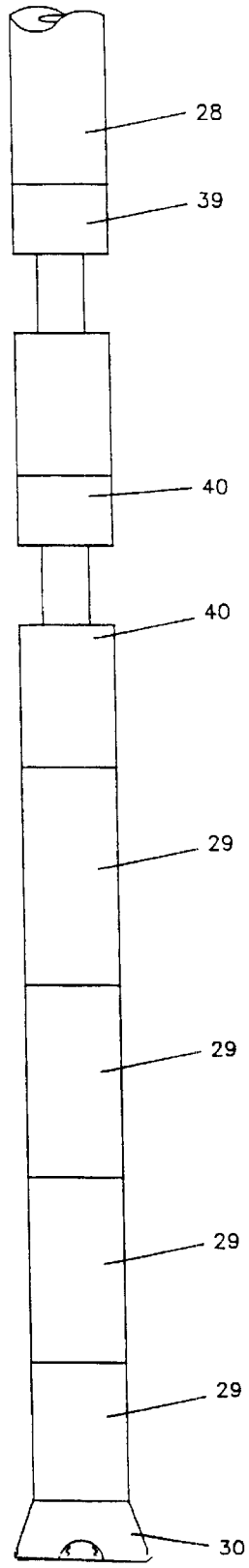
FIG. 3—An illustration showing a preferred placement of invention above the drill collars.

FIG. 3 discloses the placement of the invention in a drill string assembly 39 immediately above a drilling jar 40, which are in turn connected to the drill bit through pony drill collars. A similar placement for the use of the torque absorber in conjunction with a thruster could be accomplished, although the preferred placement of the torque absorber with a thruster would be immediately above the drill bit 30.

Figure 4:
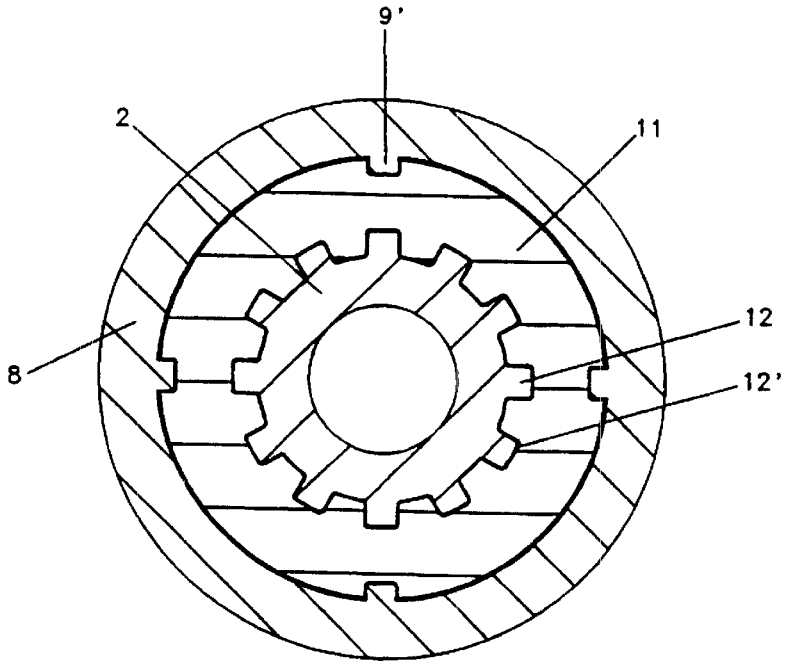
FIG. 4—A cross-section view of torque and spline sleeve section.

FIG. 4 is a top view of torque sleeve 11 engaged inside drive cylinder 8 and engaging mandrel 2. As also previously noted, internal fast threads 9' engage the external threads 9 on sleeve 11.

Figure 5:
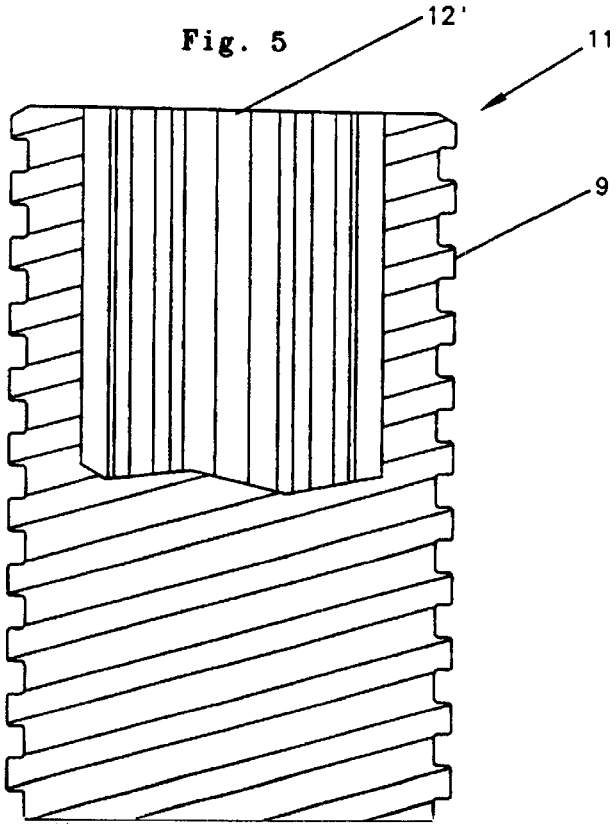
FIG. 5—An illustration showing a cut-away section of the torque sleeve splines.

FIG. 5 is part frontal view of torque sleeve with cut-away disclosing spline engagement 12 on the interior of the torque sleeve 11, and reflecting the torque threads 9 on the exterior of the torque sleeve. A plurality of circumferentially spaced fast-lead torque threads are provided on the outer surface of the torque sleeve 11 to cooperatively engage circumferentially spaced torque threads formed on the inner surface of drive cylinder 8. A plurality of circumferentially spaced spline seats are formed on the inner surface of torque sleeve 11 to cooperatively engage the splines formed on mandrel 2 to provide rotational movement.

As previously noted in FIG. 2, the apparatus is partially filled with an incompressible medium such as gear oil so that under normal drilling operation loads the down-impact face 6 is not contacting the upper end of cylinder 8. As the jar or accelerator is actuated, the normal movement of the mandrel to actuate the jar seats the cylinder against wear ring 4. Well fluids drain from the tool through port 54.

Although the description above contains many specific details, these should not be construed as limiting the scope of the invention but as merely providing illustrations of some of the presently preferred embodiments of this invention. The foregoing disclosure and description of the invention are explanatory thereof, and various changes in the size, shape, and materials as well as in the details of the illustrated construction may be made without departing from the spirit of the invention.

What is claimed is:

1. An improved drilling jar and accelerator apparatus of the type in which a knocker of a jar mechanism is threadedly engaged to a mandrel, wherein the improvement comprises:

the mandrel adapted for engagement with the knocker of the jar mechanism in a drill string, a cylinder engaging said mandrel with seal means to provide a fluid chamber therein, a torque sleeve providing internal splines on its interior surface and threads on its exterior surface carried within said fluid chamber, and cooperating means formed on said mandrel for transmission of rotational energy to the jar mechanism.

2. The invention of claim 1 wherein said cooperating means includes a spring engaging the torque sleeve and resisting movement of the torque sleeve as the sleeve is moved on the mandrel from operating rotation.

3. An abnormal torque absorbing apparatus comprising:

a mandrel for connection to a drill string and formed with external splines, a cylinder telescopically engaging said mandrel with seal means to provide a fluid chamber therein and providing threads on the interior surface of said cylinder, a torque sleeve carried on said mandrel formed with splines on the interior surface for engagement with the exterior splines of the mandrel and with external threads for engagement with the interior threads of the cylinder, wherein the threads on an interior surface of said cylinder are circumferentially spaced torque threads, and cooperating means for absorbing excessive torque in the drill string while still allowing continued rotation to be applied to the drill string.

4. An abnormal torque absorbing apparatus comprising:

a mandrel for connection to a drill string and formed with external splines, a cylinder telescopically engaging said mandrel with seal means to provide a fluid chamber therein and providing threads on the interior surface of said cylinder, torque sleeve carried on said mandrel formed with splines on the interior surface for engagement with the exterior splines of the mandrel and with external threads for engagement with the interior threads of the cylinder, wherein the external threads on said torque sleeve are circumferentially spaced fast-lead torque threads, and cooperating means for absorbing excessive torque in the drill string while still allowing continued rotation to be applied to the drill string.

5. An abnormal torque absorbing apparatus comprising:

a mandrel for connection to a drill string and formed with external splines, a cylinder telescopically engaging said mandrel with seal means to provide a fluid chamber therein and providing threads on the interior surface of said cylinder, a torque sleeve carried on said mandrel formed with splines on the interior surface for engagement with the exterior splines of the mandrel and with external threads for engagement with the interior threads of the cylinder, and cooperating means for absorbing excessive torque in the drill string while still allowing continued rotation to be applied to the drill string, wherein said cooperating means includes a resilient member engaging the torque sleeve, wherein said resilient member and torque thread movement increasingly resist abnormal torque.

6. An abnormal torque absorbing apparatus comprising:

a mandrel for connection to a drill string and formed with external splines, a cylinder telescopically engaging said mandrel with seal means to provide a fluid chamber therein and providing threads on the interior surface of said cylinder, a torque sleeve carried on said mandrel formed with splines on the interior surface for engagement with the exterior splines of the mandrel and with external threads for engagement with the interior threads of the cylinder, cooperating means for absorbing excessive torque in the drill string while still allowing continued rotation to be applied to the drill string, and wherein the fluid chamber contains a fluid and wherein said cooperating means includes a resilient member engaging said torque sleeve, said torque sleeve resisting abnormal torque by a combination of compressive movement of the resilient member, torque thread movement, and hydraulic pressure from the fluid.

7. An improved drilling jar and accelerator apparatus of the type in which a knocker of a jar mechanism is threadedly engaged to a mandrel, wherein the improvement comprises:

the mandrel with external splines, adapted for engagement with the knocker of the jar mechanism in a drill string;

a cylinder engaging said mandrel with seal means to provide a fluid chamber therein, and providing threads on the interior surface of said cylinder;

a torque sleeve carried on said mandrel formed with splines on the interior surface for engagement with the exterior splines of the mandrel and with external threads for engagement with the interior threads of the cylinder; and cooperating means for absorbing excessive torque in the drill string.

* * * * *